United States Patent [19]

Pevzner et al.

[11] 4,149,138

[45] Apr. 10, 1979

[54] THERMAL BIMETALLIC STRIP RELAY

[75] Inventors: Mark G. Pevzner; Nikolai I. Pinchuk, both of Smolensk; Pavel I. Krukover, Kaliningrad; Nikolai K. Lemchuzhnikov, Smolensk, all of U.S.S.R.

[73] Assignee: Nauchno-Issledovatelsky I Konstruktorsko-Teknologichesky Institut Teploenergeticheskogo Priborostroenia, Smolensk, U.S.S.R.

[21] Appl. No.: 810,764

[22] Filed: Jun. 28, 1977

[30] Foreign Application Priority Data

Oct. 15, 1976 [SU] U.S.S.R. ..... 2410852

[51] Int. Cl.[2] ..... H01H 37/04; H01H 37/54

[52] U.S. Cl. ..... 337/372; 337/343

[58] Field of Search ..... 337/372, 371, 370, 343, 337/365, 342, 362, 369, 380, 53, 89, 95, 101, 378

[56] References Cited

U.S. PATENT DOCUMENTS

| | | | |
|---|---|---|---|
| 2,707,738 | 5/1955 | Weissheimer et al. | 337/372 |
| 2,785,252 | 3/1957 | Parr | 337/372 |
| 3,686,605 | 8/1972 | Hire | 337/343 |

*Primary Examiner*—Harold Broome

*Attorney, Agent, or Firm*—Haseltine, Lake & Waters

[57] ABSTRACT

A thermal bimetallic strip relay comprises a case with a cover having fixed contacts attached to it from inside and provided with external leads; located inside the case are an upper and a lower supports made as bent thermal bimetallic elements that have radii of curvature of opposite signs and between which the center of a "clapping" sensitive thermal bimetallic element is located with moving contacts attached to it and arranged opposite to the fixed contacts. Similar bimetal layers of said upper and lower supports as well as those of the sensing element are arranged to face in the same direction with respect to either the lid or the case bottom. The relay is intended to enable and to disable an electric network whenever the ambient temperature of the medium under control deviates from the preset value.

3 Claims, 9 Drawing Figures

THERMAL BIMETALLIC STRIP RELAY

BACKGROUND OF INVENTION

Figure 1:
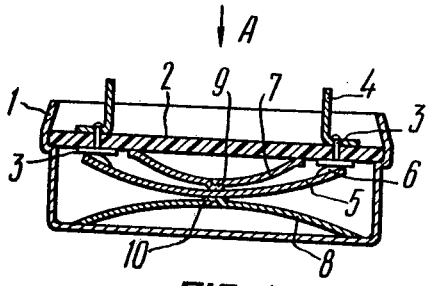

The present invention relates to electric equipment used for automatic monitor and control purposes and in particular, to a thermal bimetallic strip relay.

The thermal bimetallic strip relay is intended to enable and to disable an electric network whenever the ambient temperature of the medium under control deviates from the present value.

The prior art knows a thermal bimetallic strip relay comprising a sensor made as a thermal bimetallic "clapping" disk, moving and fixed contacts located inside a case with a lid which is provided with external leads and a device for eliminating the analog (smooth) run of the "clapping" disk.

Such a relay suffers from a drawback which consists in that the sag of the "clapping" disk varies in the course of operation and the relay tends to open the contacts before the disk could alter its state with a clap. Hence, the process of contact opening becomes smooth, which leads to contact burning and reduces the commutability of the relay.

Known in the art also is a more advanced thermal bimetallic strip relay which comprises a metal case, a lid having fixed contacts provided with external leads and secured to its internal surface, a "clapping" thermal bimetallic sensitive element having moving contacts arranged opposite the fixed ones, an upper and a lower supports rigidly mounted inside the case so that the center of the clapping sensor is located between them.

The sag of the "clapping" disk in this relay also changes, due to which the contacts open in a smooth way either before or after the sensor clap. Hence, the contacts suffer from excessive burning.

The normal operation of the relay can be provided by means of straightening the "clapping" sensor so that its sag remains constant and would not open the contacts when heated before its temperature reaches the clap level, i.e. below the operation temperature.

The required straightening can be obtained by machining relay parts to high precision. The precise dimensions are as follows: the height from lid to case bottom, height of the fixed contacts, height of the rigid upper support, height of the rigid lower support, thickness of "clapping" sensor. However, this requirement leads to considerable complexity of the relay design.

SUMMARY OF INVENTION

The object of the present invention is to simplify the design of a thermal bimetallic strip relay.

Another object of the inventi0n is to increase the reliability of the relay.

This is achieved by means of designing a thermal bimetallic strip relay comprising a case with a lid that has fixed contacts attached to its inside surface and provided with external leads, a "clapping" thermal bimetallic sensitive element with moving contacts attached to it and located opposite the fixed contacts, an upper and a lower supports arranged so that the center of the "clapping" sensor is between them in which, according to the invention, the upper and the lower supports are made as bent thermal bimetallic plates whose radii of curvature are of opposite signs, the similar layers of the bimetal used to make the upper and the lower supports as well as those of the sensitive element being located at the same side with respect to either lid or the case bottom.

Preferably the upper and lower supports are provided with bosses so the sensitive element could touch the upper and the lower supports only with its central part in the course of relay operation.

The invention will be better understood from the following description of a thermal bimetallic strip relay given by way of example with reference to the accompanying drawings in which:

IN THE DRAWINGS

Figure 5:
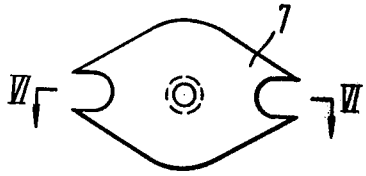
Figure 2:
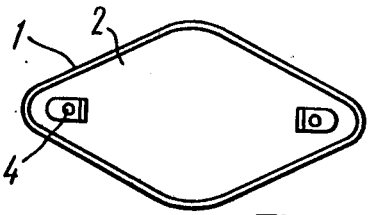
Figure 6:
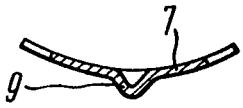
Figure 3:
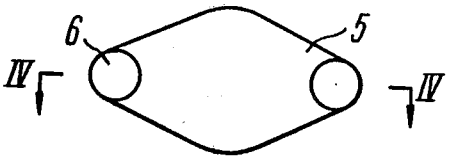
Figure 7:
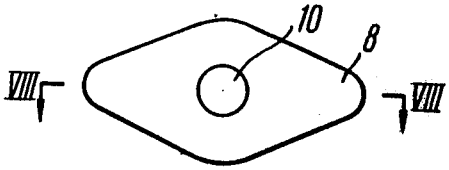
Figure 4:
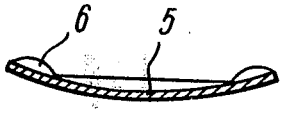
Figure 8:
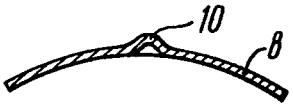
Figure 9:
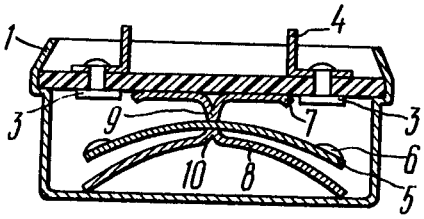

FIG. 1 presents a cross section of the thermal bimetallic relay in the initial state, according to the invention;

FIG. 2 presents the relay of FIG. 1 as viewed along arrow A;

FIG. 3 presents a sensitive element of the thermal bimetallic relay, according to the invention;

FIG. 4 presents a section along IV—IV of the sensitive element as shown in FIG. 3, according to the invention;

FIG. 5 presents an upper support of the sensitive element, according to the invention;

FIG. 6 presents a section along VI—VI of the upper support as shown in FIG. 5;

FIG. 7 presents a lower support of the sensitive element, according to the invention;

FIG. 8 presents a section along VIII—VIII of the lower support as shown in FIG. 7;

FIG. 9 presents a cross section of the thermal bimetallic strip relay after it has operated due to heating, according to the invention.

DESCRIPTION OF INVENTION

The proposed relay comprises a metal case 1 (FIG. 1) of a rhombic shape, a lid 2 of the case 1 made of a dielectric material having two fixed contacts 3 attached to it. Brought out to the outside surface of the lid 2 and attached to the contacts 3 (FIGS. 1, 2) are wires 4 while the lid 2 is secured to the case 1 by rolling. Located inside the case 1 is a "clapping" sensitive element 5 made of a thermal bimetallic strip (FIGS. 1, 3, 4) having moving contacts 6 secured symmetrically to its edges. The sensitive element 5 is clamped so that its central part is held between two supports 7, 8 - upper and lower - made of a thermal bimetallic strip.

To make the sensitive element 5 touch the upper and the lower supports 7, 8 only with its central part in the course of relay operation the upper support 7 is provided with a boss (a press-out) 9 (FIGS. 5, 6) and the lower support 8 is provided with a boss (a press-out) 10 (FIGS. 7, 8).

The relay is assembled in the following way. A prebent lower support 8 is placed onto the bottom of the case 1 so that its embossed side faces upwards. Then the "clapping" sensitive element 5 is mounted with its contacts 6 faced upwards. Superimposed on it is a prebent upper support 7 with its embossed side facing downwards. The size of the upper support 7 is somewhat smaller than that of the lower one so as not to close the contacts 3.

The sensitive element 5 and the supports 7 and 8 are rhombic in shape which is similar to that of the case 1, due to which both the sensitive element 5 and the upper and lower supports 7, 8 could be arranged in the case 1 as required. However other ways of achieving the required mutual orientation of the case, the sensitive element and the supports are also possible. For instance, round parts (sensitive element, supports) could be provided with grooves while the case could have lugs engaging the grooves, etc. After the sensitive element 5 and both supports 7, 8 are placed inside the case 1 the lid 2 of the case is fixed. The contacts 3 of the lid 2 are pressed against the contacts 7 of the sensitive element 5 and in this position the lid is fixed in the case 1.

It should be pointed out specifically that similar layers of the bimetal used to make both the supports and the sensitive element should be arranged so that they face the same side either of the case of the case bottom. In the relay design under discussion the contacts are closed at the room temperature and open when heated. The active layers of the thermal bimetal used to make the lower support, the sensitive element and the upper support are placed at the side of the case lid. In case of a relay whose contacts are supposed to open when cooled the passive layers of both the sensitive element and the two supports are located at the side of the lid.

The relay operates as follows. When heated the sensitive element 5 starts unbending in a smooth manner. At the same time unbends the upper support 7 that reduces its sag while the lower support 8 bends increasing its sag and lifting the sensor 5 and the upper support 7. Therefore, the relay contacts 3 and 6 remain closed with practically unchanged contact pressure.

As soon as the sensitive element 5 reaches its operation temperature it will change the direction of its sag with a clap and the contacts 3 and 6 will open (FIG. 9).

Subsequent cooling will cause the sensitive element 5 and the lower support 8 to straighten reducing their sags, while the upper support 7 will bend increasing its sag to push the sensitive element 5 and the lower support 7 downwards. Hence, the relay contacts 3 and 6 will remain open. As soon as the sensitive element 5 reaches the other operation temperature limit it will alter the direction of its sag with a clap and the contacts 3 and 6 will close (FIG. 1).

Thus, the smooth change of the sag, i.e. the straightening of the sensitive element 6 throughout the heating process up to the clap, is compensated for by the increase of the lower support 8 sag and throughout the cooling process it is compensated for by the increase of the upper support 7 sag. In other words the supports 7 and 8 that clamp the center of the sensitive element 5 compensate for smooth variations of the sensitive element sag when it is both heated and cooled. This design of the supports 7 and 8 allows to dramatically reduce the precision requirements for relay parts since it becomes unnecessary to straighten the sensitive element during the assembly procedure so as to take into account the preset value of the smooth change of the sag when the relay is heated or cooled until it claps. In known relay designs the same effect is obtained by means of machining relay parts to a high degree of precision. Moreover, the proposed support design reduces the number of ready parts that are rejected in case their dimensions differ substantially from the required ones. For instance, a discrepancy in the height of contacts changes the sag of the upper and lower supports without hampering the operability of the relay.

The proposed relay is equally useful as a temperature relay, a current relay and a mixed current-temperature relay since the sensitive clapping element 5 will respond to indirect, direct and mixed types of heating in a similar manner.

What is claimed is:

1. A thermal bimetallic strip relay, comprising: a capsule formed of a metal case and a cover made of thermal and electric insulating material; electric contact means disposed inside said capsule having fixed contacts attached to said cover and a spherical clapping plate of an elastic thermal bimetal, said plate having contacts secured opposite to said fixed contacts; said spherical clapping plate when cooled closes said fixed contacts by co-actions with said plate contacts; said spherical clapping plate being disposed with its center on a lower support defined as a bent elastic thermal bimetallic plate, the edges of said lower support leaning against the bottom of said capsule case; an upper support is provided as a bent elastic thermal bimetallic plate between said capsule cover and said spherical clapping plate, the edges of said upper plate being at rest on said cover and having a top thereof disposed against the center of said spherical clapping plate; and lead means secured externally to said fixed contacts attached to said cover.

2. A minature thermal bimetallic relay, comprising: a capsule formed of a case and a cover; an electric contact device disposed inside said capsule being formed with fixed contacts attached to said cover and a spherical clapping plate provided with contacts; upper and lower support means formed as bent elastic thermal bimetallic plates; said spherical clapping plate being arranged with its center between the top portion of said support means, the radii of curvature of said upper and lower support means having opposite polarity, and similar layers of the thermal bimetal of said support means and said spherical clapping plate being located at the same side with respect to said cover and said case.

3. A minature thermal bimetallic relay according to claim 1, wherein the similar layers of said metal are arranged at the same side with respect to said cover or case, being provided with bosses formed in the center of said upper and lower support means, and said spherical thermal bimetallic clapping plate being provided in the middle between said support means.

* * * * *